US005325761A

United States Patent [19]

Schwing

[11] Patent Number: 5,325,761

[45] Date of Patent: Jul. 5, 1994

[54] SWITCHING ARRANGEMENT FOR CONTROLLING THE SPEED OF HYDRAULIC DRIVES

[75] Inventor: Friedrich Schwing, Gelsenkrichen, Fed. Rep. of Germany

[73] Assignee: Friedrich Wilh. Schwing GmbH, Fed. Rep. of Germany

[21] Appl. No.: 855,980

[22] Filed: Mar. 23, 1992

[30] Foreign Application Priority Data

Mar. 25, 1991 [DE] Fed. Rep. of Germany ..... 4109754

[51] Int. Cl.[5] ..... F15B 13/04

[52] U.S. Cl. ..... 91/31; 91/444; 60/494

[58] Field of Search ..... 91/30, 31, 32, 444, 91/448; 60/494

[56] References Cited

U.S. PATENT DOCUMENTS

| | | | |
|---|---|---|---|
| 3,038,449 | 6/1962 | Murphy et al. | 91/31 |
| 3,081,942 | 3/1963 | Maclay | 91/31 |
| 3,474,826 | 10/1969 | Breitsprecher et al. | 91/31 |
| 3,802,318 | 4/1974 | Sibbald | 91/4 R |
| 3,973,747 | 8/1976 | Jagerstrom . | |
| 4,166,506 | 9/1979 | Tezuka et al. | 91/529 |
| 4,518,011 | 5/1985 | Stoll | 91/31 |

FOREIGN PATENT DOCUMENTS

| | | |
|---|---|---|
| 1550757 | 7/1971 | Fed. Rep. of Germany . |
| 99503 | 6/1983 | Japan . |
| 1487294 | 9/1977 | United Kingdom . |

*Primary Examiner*—Edward K. Look
*Assistant Examiner*—F. Daniel Lopez
*Attorney, Agent, or Firm*—Kinney & Lange

[57] ABSTRACT

A switching arrangement for controlling the speed of hydraulic drives, wherein a speed of the drive is assigned to a corresponding flow rate of a hydraulic medium. The flow rate is determined by a preselected pair of phased nozzles placed in the inlet and outlet lines. The nozzle flow rates are selected such that switching between a series of nozzle pairs creates a smoothly changing speed of the hydraulic drive, thus eliminating jolting during starting and braking.

4 Claims, 2 Drawing Sheets

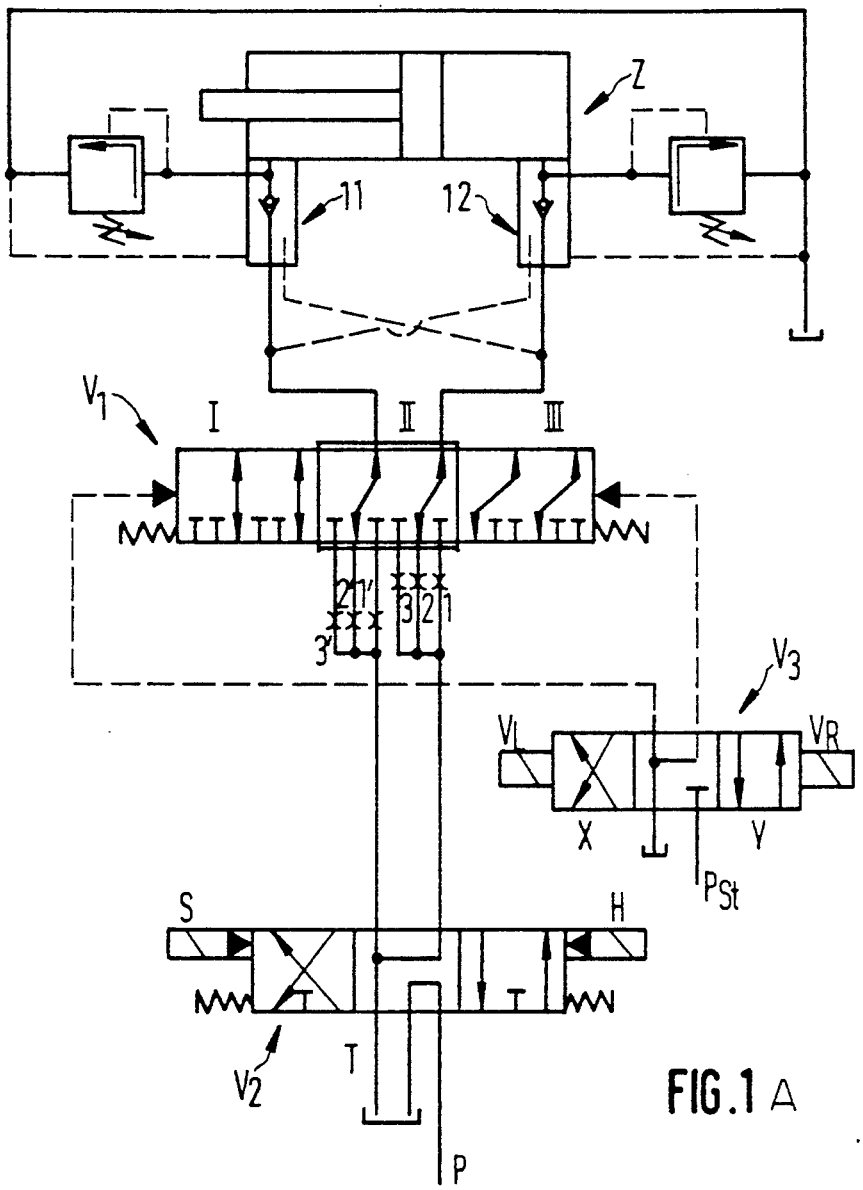
FIG.1 A
FIG.1 B
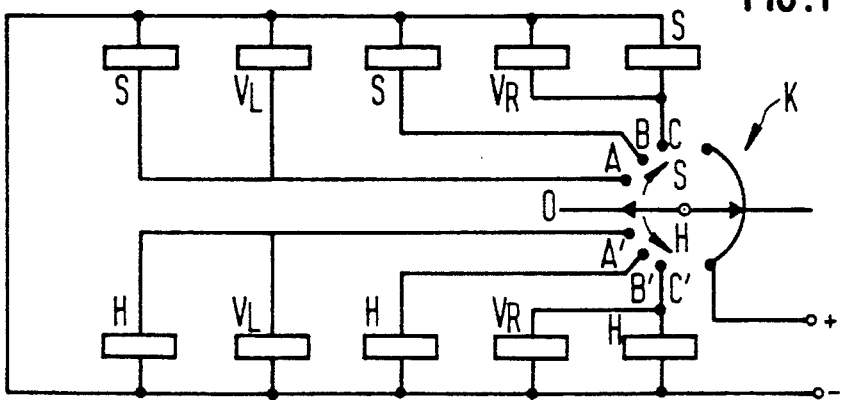

SWITCHING ARRANGEMENT FOR CONTROLLING THE SPEED OF HYDRAULIC DRIVES

BACKGROUND OF THE INVENTION

The invention relates to a switching arrangement for controlling the speed of hydraulic drives.

The invention relates to hydraulic drives in which the speed derived from the drives depends on the amount of hydraulic medium directed to the drive within a given time unit, wherein the absorption amount of the drive generally is not variable. This invention is applicable to various known hydraulic drives which, as a rule, are constructed in a simple manner. In practice, such drives serve various purposes, such as the supply of kinetic energy to slewing gears of steam shovels and cranes. The invention relates in particular to so-called thrust pistons, which produce a kinetic energy via a reversible piston of a hydraulic working cylinder. For this reason, the invention is described in the following text on the basis of this preferred application.

Generally, hydraulic thrust pistons are driven at a constant speed from a standstill point and are fully braked from the respective speed. In these cases, a 4/3 distributing control valve slide is used which, in both extreme positions, alternates the pressure and the tank line. However, in the middle position, the 4/3 distributing control valve slide switches the pump contained in the thrust generator to circulation, i.e. to the tank of the hydraulic medium. With such drives, the piston speeds are nearly constant in both directions. If the thrust piston is driven by the load in one or both directions of movement, a load holding valve is required on the outlet side, i.e. a hydraulic pilot controlled check valve or brake valve is required to prevent the thrust piston from passing and to let the piston run in the cylinder at a speed corresponding to the predetermined flow of the hydraulic medium.

Such a hydraulic switching arrangement, also described as an on-off control, is provided, for example, for the drive cylinders of pivotable booms or masts. For example, crane of concrete distributor masts have hydraulically driven joints that connect the mast section(s) to each other. Here, the drive cylinders are regularly under the load of the mast section extending from the respective joint and possibly under the loads effecting same, such as a concrete supply line. The on-off control has the property of fully applying pressure to the drives. This results in jerky starts and braking of the joint movement. Apart from the wear connected therewith, abrupt starting and braking frequently causes the mast to oscillate, thus, possibly increasing the mechanical load on the structural components to a dangerous level, possibly resulting in accidents and damage.

Attempts have already been made to counteract such disadvantages. One of these suggestions involves supplementing the described on-off switching arrangement with a throttle or restrictor having a constant cross-section (throttle), whereby the disadvantageous oscillating jolts are eliminated. Such switching arrangements also make it possible with a thrust generator, having a pump with constant supply flow, to supply several hydraulic circuits with respectively varying partial amounts of hydraulic medium which are independent of the respective operating pressures present in the circuits. Furthermore, in the inlet and outlet between the control valve and the working cylinder, respectively, a throttle is built in, wherein the throttles are so attuned to each other that the throttle in the outlet, during maximum load including the blocking pressure load, lets through the amount of hydraulic medium destined for this circuit; in contrast thereto, the nozzle in the inlet is adjusted in such a way that when the amount of hydraulics medium destined for this circuit is let through, there exists behind the throttle the required unlocking pressure, while in front of the throttle, the relief valve pressure is barely reached.

While with such a switching arrangement merely the oscillation jolts are reduced, it is possible with proportional controls to achieve continuous speed alternations of the speed derived from the drive which constitutes a substantially better means for reducing the starting and braking jolts. With a proportional control of this type, a control valve is provided in front of the drive which electromagnetically alters the opening cross-section of fine control grooves which is nearly proportional to the speed. The electromagnetic adjustment of the control valve and thus that of its pilot control grooves involves a potentiometer circuit which further considerably increases the already elevated expense, due to the electrical components. Furthermore, such switching arrangements, due to the fine control grooves, are susceptible to soiling so that frequent disruptions are unavoidable, which are mostly brought about due to jamming of the valve. Moreover, the handling of such controls via the command switch is difficult because the latter has to be very delicately adjusted.

SUMMARY OF THE INVENTION

In accordance with the invention, the strictly proportional control is given up in favor of a phased proportionality, the phases of which are determined by the throttle pairs, wherein through the selection of a number of the throttle pairs and of phase difference, the phase leaps may be increased or reduced nearly continuously and in accordance with the requirements of the individual case. The respective speed phases are selected and set via the command switch, which for this reason may be provided with a corresponding number of switching positions.

The invention has the advantage that it permits speed differences corresponding to the proportionality, which can be used in any desired manner, among other things to start and brake the hydraulic drive smoothly, wherein the command switch is operated until the desired maximum speed or the standstill of the drive has been reached.

When the drive, operated in this manner is to be improved, for example, with respect to its starting or its braking process, a direction control valve slide for the selection of the drive direction may be added. The direction control slide on the pump side may, for example, be realized with a typical 5/3-distributing valve. If a connection disruption occurs at the speed control valve slide, the drive is not endangered. Rather, the switching arrangement of the invention then becomes an on-off control at the speed phase set on the speed control valve switch until the disruption is corrected.

For safety reasons, it is recommended that the speed control valve slide be provided in the switching position of the lowest speed phase and that the following speed phases can be switched against pretensioning. In this way, it is assured that the drive can be started only with the lowest speed phase and braked from the highest speed phase.

The new switching arrangement can be operated mechanically. In this case, the simplest arrangement of the invention includes two mechanical switches, one of which serves for starting and braking the drive, while the drive direction is preselected or the drive is brought to a stop with the other switch.

However, generally, an embodiment of the switching arrangement of the invention is recommended which can be operated remotely across greater distances. A command switch may be utilized to remotely activate and control the direction control slide valve and the speed control slide valve. In this instance, the difficulties during through switching of the speed control valve switch are eliminated, which are connected with switching forces to be applied mechanically. This arrangement can be set mechanically or magnetically.

BRIEF DESCRIPTION OF THE DRAWINGS

In the following text, the invention is further explained by means of drawings. It is shown in FIGS. 1A and 1B, the mechanical-electrical circuit diagram of a primary arrangement of the switching arrangement of the invention.

DETAILED DESCRIPTION OF THE PREFERRED EMBODIMENTS

Figure 2:
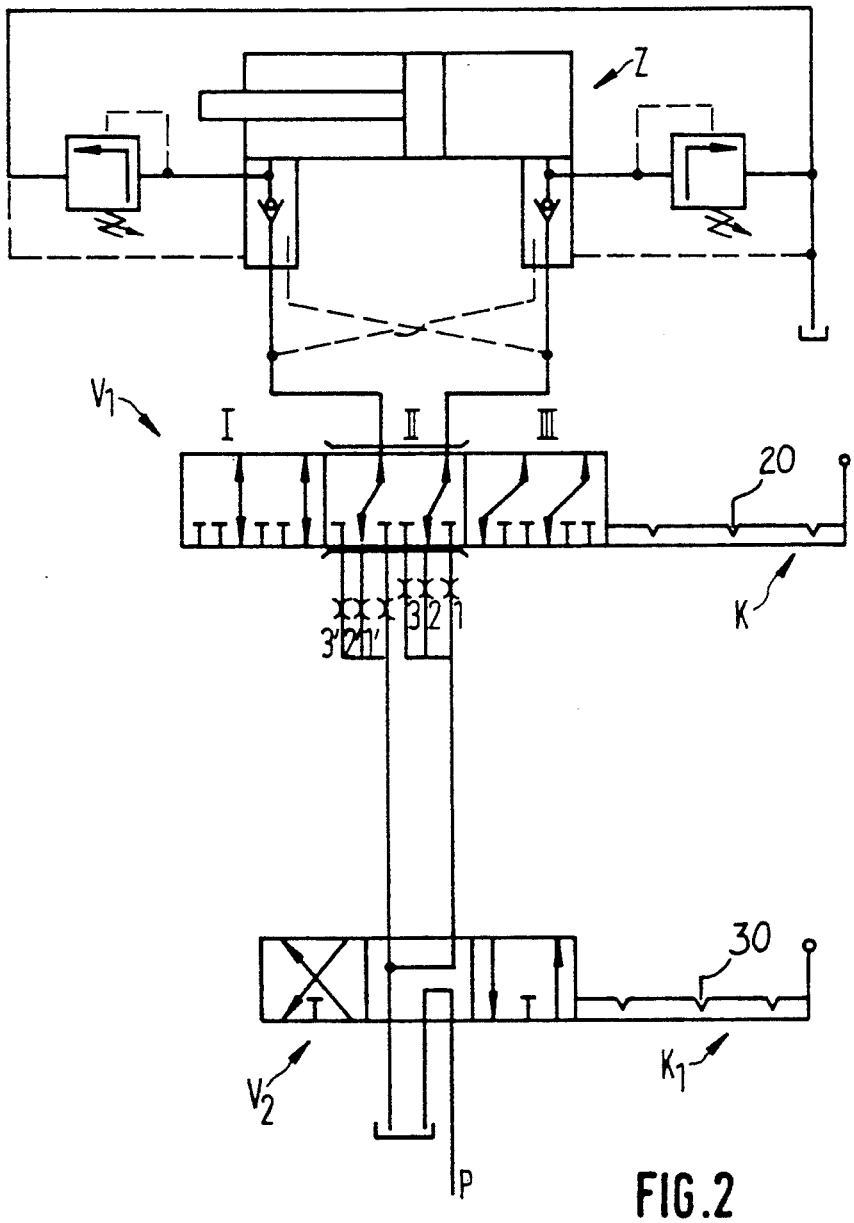
FIG. 2, a mechanical embodiment of the new switching arrangement in the illustration corresponding to FIGS. 1A and 1B.

According to the illustration in FIGS. 1A and 1B, a switching arrangement represented there serves as a speed control of a piston of a hydraulic drive which, in accordance with the example shown, is in the form of a thrust piston (Z). One load holding valve each is assigned to a piston ring chamber and a piston area chamber. Each of the valves can be hydraulically unblocked via lines shown in dotted lines. The lines of the load holding valves (11, 12) represented in extracted form, serve alternatingly with respect to sides as in- or outlet line and end at a control valve slide (V1) on the drive side.

In accordance with the example shown, this control valve slide (V1) has three switching positions described with referenced characters I, II and III in FIG. 1. Each switching position, in accordance with the shown arrangement, has eight paths (two cylinder side and six on throttle side). Respectively, two of the paths on the throttle side pass through to the cylinder side, the remaining paths are blocked. The switching positions distinguish themselves through the arrangement of the valve gates. These are selected in such a way that in each of the switching positions, one of three parallel-connected throttles (1 to 3 or 1' to 3') is assigned. In accordance with their ordinal numbers, the throttles are assigned to each other in pairs. In the switching position (I), the valve gates are switched to the throttles (1, 1'), in the switching position (II) to the throttles (2, 2') and in the switching position (III) to the throttles (3, 3'). Each of these throttles has a predetermined opening which is assigned to a speed phase of the drive. In the switching position (I), the throttles (1, 1') are switched through with the smallest bore and thus with the lowest speed assigned to the drive (Z), while with the switching position (II) an intermediate speed is assured with the throttles (2, 2') and in the switching position (III) the greatest speed is reached because the throttles (3, 3') permit the greatest amount of hydraulic medium to pass.

In the example shown in FIGS. 1A and 1B, the speed control slide (V1) is provided (preswitched) with a direction control slide (V2). In the outlet lines of this direction control slide (V2), which is also in the form of a distributing valve, the parallel-connected switched throttles (1 to 3 or 1' to 3') are located. The direction control slide (V2) is switched in a mechanically magnetic manner and blocks the piston chambers of the speed control valve slide (V1) in the middle switching position. In the two additional switching positions of the direction control valve slide (V2), the passages for the forward and return stroke of the piston are provided.

Furthermore, in the example of FIGS. 1A and 1B, a control valve slide (V3) is provided which serves for the anticipatory control of the speed control valve slide (V1). It is in the form of a 4/3 distributing valve and is magnetically switched. In its middle position, it switches the speed control valve slide (V1) to the switching position (II) which is maintained by means of the springs arranged on both sides. In the two outer positions, the switching phases (I or III) are reached, which occurs against the force of a compression spring.

In the switching arrangement according to FIGS. 1A and 1B, a command switch (K) is provided for the operation of the switching arrangement. A switching member may be turned, for example, in clockwise direction, whereby pressure is applied to the piston ring chamber, which becomes apparent in that in all switching positions (A, B, C) the switching relay (S) is always switched which moves the direction control valve (V2) into the (S) position, whereby the selection of the direction of movement is established, in this case "lowering".

The passage through the switching positions (A, B, C) corresponds to the direction of the increasing speed of the drive, in this case of the piston of the thrust piston (Z). There, the switching positions (A, B, C) of the switching element are forcibly connected with the valve positions (I, II, III) of the speed control valve (V1). In the switching position (A), the relay (VL) and thus the anticipatory control valve (V3) are operated in such a way, that the control pressure ($P_{St}$) is applied to the speed control valve (V1) in such a way that it assumes the position (I) of the lowest speed. In the switching position (C), the relay (VR) and thus the anticipatory control valve (V3) are operated in such a way, that the control pressure ($P_{St}$) is applied to the speed control valve (V1) in such a way, that is assumes the position (III), equal to the highest speed. Finally, in the switching positions (B), by not applying pressure to the anticipator valve (V3) and thus also not to the speed control valve (V1), the latter reaches the spring-centered middle position (II) which is equal to the medium speed.

The switching element of the command switch (K) may also be set in the opposite direction, i.e. against the clockwise direction, whereby pressure is applied to the piston chamber, which can be seen by the fact that with all switching positions (A', B', C') a switching relay (H) is always switched, which switches the direction control valve (V2) into the (H)-position, whereby the direction of movement, in this case "lifting," is established.

The speed gradation takes place in a manner analogous with the passage through the previously described switching positions (A, B, C).

The example, in accordance with FIG. 2, distinguishes itself from the example of FIG. 1 by its mechanical structure. In this case, only the control valve slides (V1 and V2) are required because the command switch (K) is in mechanical form, i.e. is directly connected with the switching element of the speed control slide (V1). Its mechanical output has for each speed phase or its switching position a notch inside the speed control valve slide (V1), wherein the notch assigned to the switching phase (II) is indicated by notch 20 (FIG. 2).

A second mechanical command switch (K1) is provided on the direction control valve slide (V2). Also its outlet has notches, depending on the number of switching positions involved, wherein the middle switching position is identified by notch 30 in FIG. 2.

What is claimed is:

1. A switching arrangement for a speed control of a hydraulic drive having an inlet line and an outlet line, the hydraulic drive being selectively driven at any one of a plurality of particular drive speeds, said selected drive speed being selected and set via a command switch, the switching arrangement comprising:

a plurality of pairs of fluid restrictions, such that each restriction in a particular pair of restrictions correspond to a same particular drive speed and each pair of restrictions corresponds to a particular drive speed different than a drive speed for any other of said pairs of restrictions; and a speed control valve slide having a plurality of switching positions, for selectively connecting said inlet line to one of said restrictions in said selected pair of restrictions and said outlet line to the other of said restrictions in said selected pair of restrictions, with the position of the speed control valve slide being controlled by said command switch such that said pair of restrictions are connectable to said inlet and outlet lines in an order of increasing or decreasing drive speed.

2. A switching arrangement, in accordance with claim 1, further comprising a direction control valve slide for selecting a drive direction of said hydraulic drive, by selectively connecting said inlet and outlet lines to a pressure and tank line, respectively, or to said tank and pressure line, respectively, with each said selective connection being via one of said pairs of restrictions.

3. A switching arrangement, in accordance with claim 2, wherein said speed control valve slide is pilot operated by an anticipatory control valve and wherein the command switch controls both the direction control slide and the anticipatory control valve.

4. A switching arrangement, in accordance with claim 1, wherein said speed control valve slide is biased to a position of lowest drive speed.

* * * * *

UNITED STATES PATENT AND TRADEMARK OFFICE

CERTIFICATE OF CORRECTION

PATENT NO. : 5,325,761

DATED : July 5, 1994

INVENTOR(S) : FRIEDRICH SCHWING

It is certified that error appears in the above-indentified patent and that said Letters Patent is hereby corrected as shown below:

Col. 2, line 5, delete "nozzle", insert --throttle--

Col. 3, line 49, before "throttle", insert --the--

Signed and Sealed this

Twenty-fifth Day of October, 1994

*Attest:*

*Attesting Officer*

Bruce Lehman

BRUCE LEHMAN

*Commissioner of Patents and Trademarks*